US006464474B2

(12) United States Patent
Schluecker

(10) Patent No.: US 6,464,474 B2
(45) Date of Patent: Oct. 15, 2002

(54) NONRESPIRATORY DIAPHRAGM CHUCKING

(75) Inventor: Eberhard Schluecker, Obersulm/Willsbach (DE)

(73) Assignee: LEWA Herbert Ott GmbH + Co., Leonberg (DE)

( * ) Notice: Subject to any disclaimer, the term of this patent is extended or adjusted under 35 U.S.C. 154(b) by 0 days.

(21) Appl. No.: 09/808,109

(22) Filed: Mar. 15, 2001

(65) Prior Publication Data

US 2001/0038796 A1 Nov. 8, 2001

(30) Foreign Application Priority Data

Mar. 16, 2000 (DE) ..... 100 12 902

(51) Int. Cl.[7] ..... F04B 9/08

(52) U.S. Cl. ..... 417/383; 417/395; 417/571; 92/96

(58) Field of Search ..... 417/383, 395, 417/571; 92/96, 98 R, 101, 104

(56) References Cited

U.S. PATENT DOCUMENTS 2,764,097 A * 9/1956 Browne ..... 417/386
3,000,320 A * 9/1961 Ring ..... 417/383
3,093,086 A * 6/1963 Altoz et al. ..... 92/102
3,338,171 A * 8/1967 Conklin et al. ..... 417/339
3,386,388 A * 6/1968 Rosenberg ..... 417/395
3,387,566 A * 6/1968 Temple ..... 417/403
4,837,068 A * 6/1989 Martin et al. ..... 92/103 M
5,131,226 A * 7/1992 Hendry ..... 60/418

* cited by examiner

*Primary Examiner*—Charles G. Freay
*Assistant Examiner*—John F Belena
(74) *Attorney, Agent, or Firm*—Jacobson Holman, PLLC

(57) ABSTRACT

A diaphragm pump with a pump lid, a pump housing and a hydraulically powered diaphragm that is arranged between the former, that delimits a hydraulic chamber from a delivery chamber and that is clamped in a circulating rim. There is provided between the pump lid and the pump housing an insert part, which is located on the side of the pump lid and which limits the delivery chamber and/or an insert part that is located on the side of the pump housing and that delimits the hydraulic chamber, while the diaphragm at its circulating rim is clamped between the insert part and the pump housing or the pump lid or between insert parts.

36 Claims, 3 Drawing Sheets

NONRESPIRATORY DIAPHRAGM CHUCKING

FIELD OF THE INVENTION

This invention relates to a diaphragm pump.

BACKGROUND OF THE INVENTION

Growing environmental protection requirements, combined with strict legal requirements, can be met mostly only with the help of hermetically sealed process systems. Nonleaking fluid machines such as, for example, pumps and condensers, are of the utmost importance in this connection. Diaphragm pumps constitute an optimum solution, especially for delivering toxic, hazardous, annoying, sensitive, abrasive, corrosive fluids as well as for aseptic conditions. The diaphragm, as the central element, performs the double function of static seal and displacers in the form of an elastic delivery chamber wall. The static diaphragm seal is the basis for the hermetic tightness of diaphragm pumps. The diaphragm furthermore transmits the oscillating stroke motion of a drive through the fluid that is to be delivered, as a result of which, it is not only the pulsating delivery that materializes, but there is also an interaction with the fluid masses in the pipeline system. In the case of diaphragm pumps with hydraulic diaphragm drive, the oscillating motion of a drive member is transmitted via a hydraulic seal—which comprises a hydraulic fluid—to the diaphragm. The hydraulically driven diaphragm always works with balanced pressure and need withstand only deflection stresses.

PTFE (polytetrafluoroethylene) proved effective in diaphragm pump engineering due to its outstanding chemical stability and the good physical properties so that it became the standard material for diaphragms. Customary diaphragm designs are pure PTFE diaphragms with rotationally symmetrical shaft contour or flat contour and PTFE as protective layer on elastomer diaphragms.

The limit for the use of PTFE as diaphragm for diaphragm pumps currently is found at a delivery pressure of 350 bar and a temperature of 150° C. The reasons for these limitations are found in the cold-flow resistance that is no longer adequate and the tight sealing pressure of the PTFE in the diaphragm chucking. In addition, there is the fact that the parts between which the diaphragms are clamped, that is, pump bodies and diaphragm gear housing, are deformed due to the changing pressure in the pump, which results in a certain "respiration" in the chucking. This term "respiration" refers to a decrease in the adaptation pressure between the pump lid and the pump housing in the chucking area of the diaphragm, a decrease that keeps recurring possibly periodically during the operation of the diaphragm pump. The respiration increases with increasing pressure and growing structural size. The potential for elasticity equalization by the diaphragm, however, is very limited so that, as a result, there is also a limit for increasing the pressure and the structural size. Furthermore, the recurring stress change of the diaphragm due to respiration constitutes a severe mechanical stress or dynamic alternating stress and after a corresponding period of time causes the fatigue of the diaphragm material and finally a destruction of the diaphragm. This action mechanism so far has not been recognized in this form.

There is particularly intensive "respiration," especially in the case of large diaphragm pumps; this leads to the premature fatigue of the material of the diaphragm, for example, PTFE in the diaphragm chucking, and produces corresponding diaphragm ruptures or leaks.

SUMMARY OF THE INVENTION

The object of the invention therefore is to provide a diaphragm pump of the kind mentioned above, which eliminates the above-mentioned disadvantages and which can be used also at higher delivery pressures and higher operating temperature; the diaphragm chucking (or circulating rim of the diaphragm) should be made in as nonrespiratory fashion as possible or respiration should be equalized.

In the invention-based diaphragm pump, there is provided between the pump lid and the pump housing an insert part that is on the side of the pump lid and that limits the delivery chamber and/or an insert part on the side of the pump housing that limits the hydraulic chamber. At its circulating rim, the diaphragm is clamped between the insert part and the pump housing or the pump lid or between the insert parts.

This design offers the advantage that the diaphragm pump is suitable also for high pressure, for example, above 350 bar, and for higher temperatures, for example, over 150° C; this is because, on the one hand, the pressure support and the diaphragm chucking are arranged separately from each other and, on the other hand, the tool insert parts are arranged in such a manner that the pressure is balanced so that any occurring pressures between the pump lid and the pump housing cannot exert any major influence on the diaphragm chucking. This results in "nonrespiratory" diaphragm chucking. Furthermore, the diaphragm chucking depends on the size of the pump head.

In a practical manner, the insert part on the side of the pump lid has a first duct that connects the delivery chamber formed by the insert part on the side of the pump lid with a delivery duct made in the pump lid as well as a second duct that connects the delivery chamber formed by the insert part on the side of the pump lid with a suction duct made in the pump lid.

In a preferred embodiment, the pump lid and the pump housing have fastening means in such a way that the pump lid and the pump housing are connected with each other in a pressure-supported fashion and that, at the same time, the two insert parts—the membrane in between them—are pressed against each other in a chucking fashion.

In a practical manner, the insert parts are so arranged and shaped that they directly abut against each other in a radial area around the diaphragm chucking. Here, the insert parts, together with the pump lid or the pump housing, form tightly sealed points. Ducts or free turns are preferably arranged between the insert parts and the pump lid or the pump housing in such a manner that the pumping fluid will spread all the way to the tightly sealed points under pressure. In a particularly advantageous manner, the diaphragm is so clamped with a predetermined press-on force between the pump lid and the pump housing that the pressure in the area of the diaphragm chucking will be below the yield point of a material of the diaphragm.

In a preferred development of the invention, there is provided in the clamping area, in addition, at least one elastic part that is so designed that it will elastically balance out any reductions in the press-on pressure occurring during the operation of the diaphragm pump in the chucking area of the diaphragm between the pump lid and the pump housing. As a result, the tight seal pressure that acts upon the diaphragm can be set in a defined manner. This is particularly important for diaphragms that are made, for example, of PTFE because, on the one hand, the maintenance of the tight sealing effect requires at least a minimum pressure, while, on the other hand, the maximum permissible pressure is limited.

At the same time, the two insert parts are sealed against the pump lid or the pump housing in such a way that both tightly sealed points are arranged on one and the same diameter. Here it is advantageous when the diameter of the two tight sealing points is identical or larger in relation to the diameter of the chucking parts of the diaphragm so that one can attain essentially balanced pressure conditions on both sides of the insert pieces. In that way, one can achieve a "nonrespiratory" diaphragm chucking and one can attain a reliable and reliably functional diaphragm seal.

This design offers the advantage that the diaphragm pump will be suitable also for high pressures, for example, above 350 bar, and for higher temperatures, for example, more than 150° C. because the deformations of the pump lid and pump housing, which occur in this area and which would lead to a decrease in the press-on pressure in the clamping area, will be effectively balanced out. At the same time, one can compensate for a cold-flow strength and tight sealing pressure of the membrane material that might possibly no longer be sufficient under certain operating conditions. In other words, the invention-based arrangement increases the elasticity of the diaphragm in the chucking area so that the minimum pressure required for a tight sealing effect will be retained in the chucking area of the diaphragm also in case of a deformation of the parts that are involved in the chucking area. The elastic part, provided according to the invention, is used for the compensation of oscillations of the press-on pressure in the chucking area of the diaphragm.

The elasticity reserves of a diaphragm packet are increased in the following manner: the diaphragm has two or more material layers and at least one elastic part is arranged between at least two layers. Here, the elastic part, for example, is made as an elastic intermediate layer or as an elastic intermediate ring.

To ensure a flow-directing connection between the internal chamber of two material layers of the diaphragm and a diaphragm rupture sensor, the elastic part is advantageously made as a weft.

To adjust the material deformations over the entire chucking area in the circumferential direction, the elastic part extends over the entire circumference of the diaphragm.

The elastic part can be arranged on one side or on both sides of the diaphragm. In a preferred embodiment, the elastic part comprises one or several elastomer O-rings. As an alternative, the elastic part is made as a lip seal.

The elastic part is an integral part of the diaphragm for simple and fast assembly.

In a practical manner, the diaphragm is made of PTFE or PE or, alternatively, of an elastomer with a protective layer consisting of PTFE.

BRIEF DESCRIPTION OF THE DRAWINGS

The invention will be explained in greater detail below with reference to the drawings. The latter shows the following.

DETAILED DESCRIPTION OF THE PREFERRED EMBODIMENTS

Figure 1:
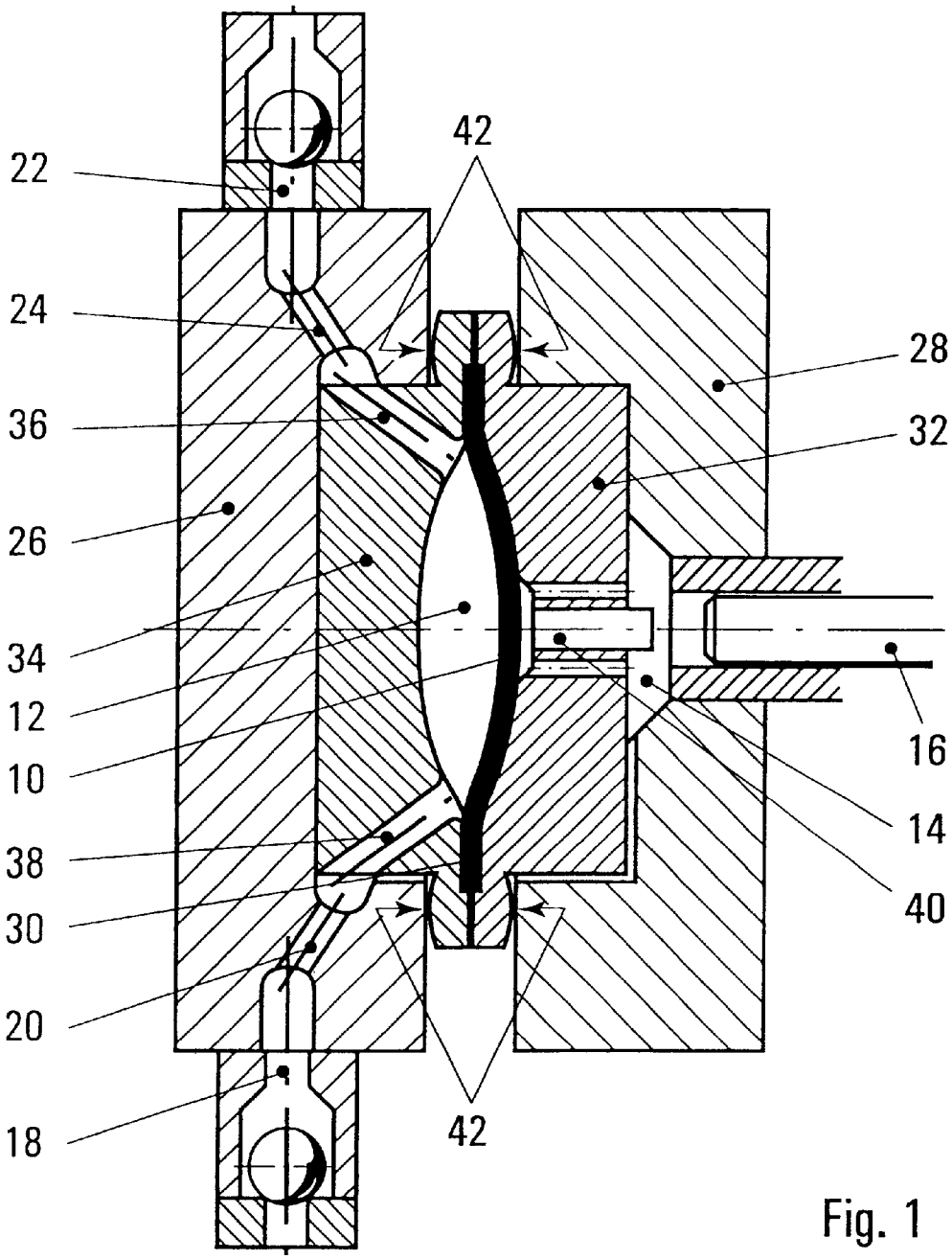
FIG. 1 is a diagram illustrating a profile of a preferred embodiment of an invention-based diaphragm pump.

As one can see in FIG. 1, the illustrated diaphragm pump comprises a diaphragm 10 that separates a delivery chamber 12 from a hydraulic chamber 14. As a drive, there is provided a piston 16 which, when in operation, oscillates around a constant central distant position. The oscillating motion of piston 16 is transmitted via a hydraulic fluid in the hydraulic chamber 14 and a piston 40 possibly connected with diaphragm 10 to diaphragm 10, which performs a corresponding oscillating motion around a central position. In this way, fluid is suctioned in via inlet valve 18 and a suction duct 20 of the diaphragm pump and is then discharged again via outlet valve 22 and via a delivery duct 24.

Diaphragm 10 is chucked between a pump lid 26 and a pump housing 28 in a predetermined radial chucking area 30. For this purpose, there are provided an insert part 32 that is located on the side of the pump housing and that limits the hydraulic chamber 14, plus an insert part 34 that is located on the side of the pump lid and that limits delivery chamber 12, which two insert parts are arranged between the pump lid 26 and pump housing 28 and clamp diaphragm 10 in radial chucking area 30. In other words, the lid of the diaphragm pump is subdivided into a pump lid 26 that receives a pressure and insert part 34 that is located on the side of the pump lid and that forms the diaphragm chucking. Furthermore, the housing of the diaphragm pump is subdivided into pump housing 28, which receives a pressure, and the insert part 32 that is located on the side of the pump housing and that forms the diaphragm chucking. As a result, the pressure support between pump lid 26 and pump housing 28 is separated from the diaphragm chucking so that any occurring pressures can no longer lead to deformations or pressure fluctuations in the area of diaphragm chucking 30 and thus to a "respiration" in the area of the diaphragm chucking.

Insert parts 32, 34 abut against each other surrounding diaphragm chucking 30 in a radial manner; this provides the advantage of a metal-metal abutting around the diaphragm chucking 30. Together with pump parts 26, 28, insert parts 32, 34 constitute two tight sealing points 42 that are arranged radially in the same spot. Tight sealing points 42 are arranged at least on the same or a larger diameter than chucking parts 30 of diaphragm 10. Diaphragm chucking 30 is thus surrounded along its complete circumference by pressure and is therefore "nonrespiratory" with relation to diaphragm chucking 30, assuming that tight sealing point 42 is in a suitable position. Insert part 34 on the side of the pump lid has a first duct 36, which connects the delivery chamber 12 formed by insert part 34 that is located on the side of the pump lid with the delivery duct 24 that is formed in pump lid 26. Insert part 34, located on the side of the pump lid, furthermore has a second duct 38 that connects the delivery chamber 12, formed by insert part 34 located on the side of the pump lid with the suction duct 20 formed in pump lid 26.

A corresponding recess in the area of diaphragm chucking 30 for the purpose of inserting diaphragm 10 is so dimensioned that only a predetermined part of the press-on pressure acting between insert parts 32, 34 will also act upon diaphragm 10 in diaphragm chucking 30. Thus, the described embodiment achieves a spatial separation of pressure support and diaphragm chucking and thus also of the diaphragm seal, as a result of which, any possibly mutually competing, partly opposing requirements can be better met in the various places. The metallic tight sealing point 42, for example, requires high surface pressures that additionally can be supported by a ball-shaped contour of insert pieces 32, 34. On the other hand, diaphragm chucking 30, when PTFE diaphragms are used, will permit only limited surface area pressure due to the flowability and the deformability of the PTFE material. At the same time, "respiration" is mostly eliminated by diaphragm chucking 30 where the pressure is balanced out with the help of insert pieces 32, 34. As a result, one can tap into pressure areas that so far were reserved only for diaphragm pumps with metallic diaphragms.

An elastic element 46 is arranged in chucking area 30 as a preferred development of the invention in addition to diaphragm 10, as one can see, for example, in FIGS. 2 to 5. This elastic element 46 adjusts "respiration" in the chucking area 30 at any point in time and ensures the pressure required for a tight sealing effect. As a result, adequate surface area pressure of the diaphragm chucking 30 is ensured also at high pressure and temperature stresses, which go beyond the permissible stresses on known diaphragm pumps.

The invention-based diaphragm chucking thus acts as elasticity adjustment because the elastic part 46 is provided in the chucking area 30 of diaphragm 10.

Figure 2:
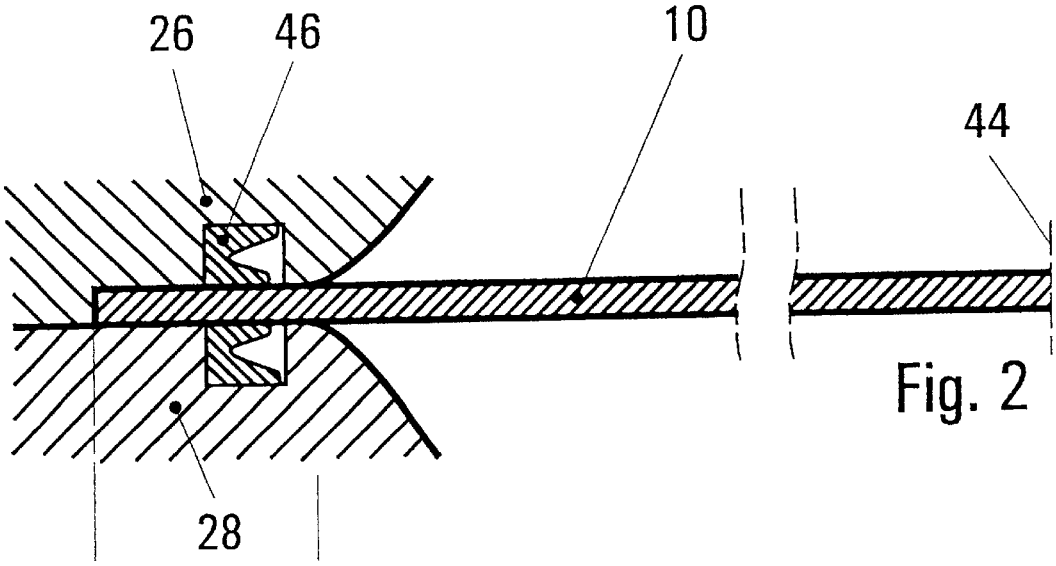
FIG. 2 show a cutaway detail view of a first embodiment of an elastic part provided according to the invention.

In the first embodiment illustrated in FIG. 2, the elastic part 46 is made as a lip ring that is arranged either on one side or, as shown in FIG. 2, on both sides of diaphragm 10 in chucking area 30.

Figure 3:
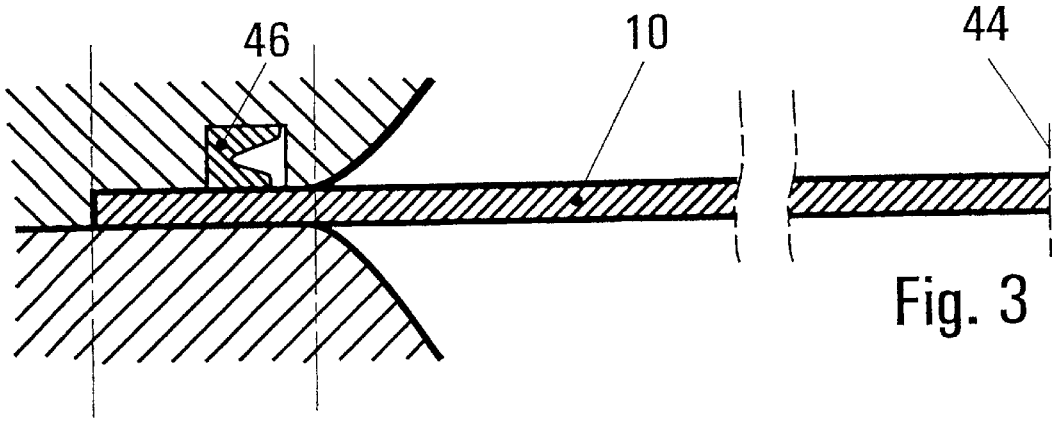
FIG. 3 shows a second embodiment of the elastic part.

In the modified embodiment according to FIG. 3, the lip ring of elastic part 46 is made integrally with diaphragm 10 so that upon insertion of diaphragm 10, elastic part 46 will automatically be arranged and mounted in chucking area 30.

Figure 4:
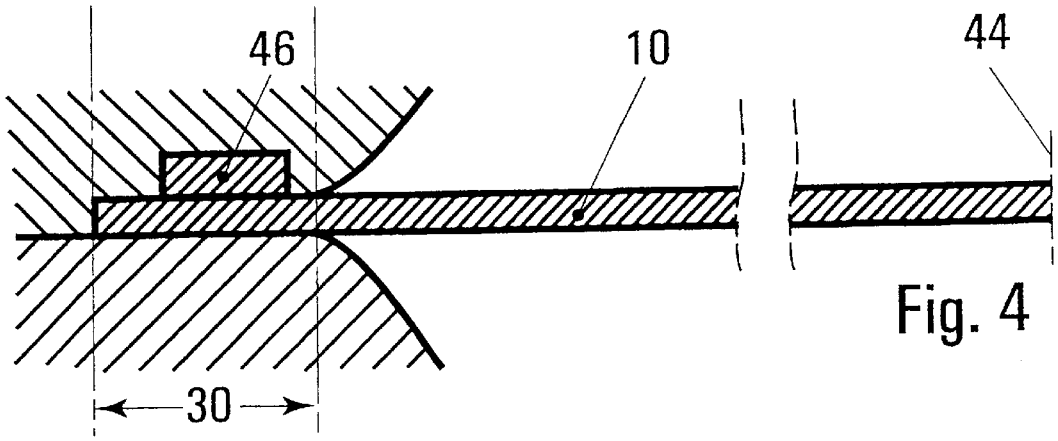
FIG. 4 shows a third embodiment of the elastic part.

Looking at the other embodiment according to FIG. 4, the elastic part 46 is made as elastomer O-ring and is arranged around the entire circumference in chucking area 30.

Figure 5:
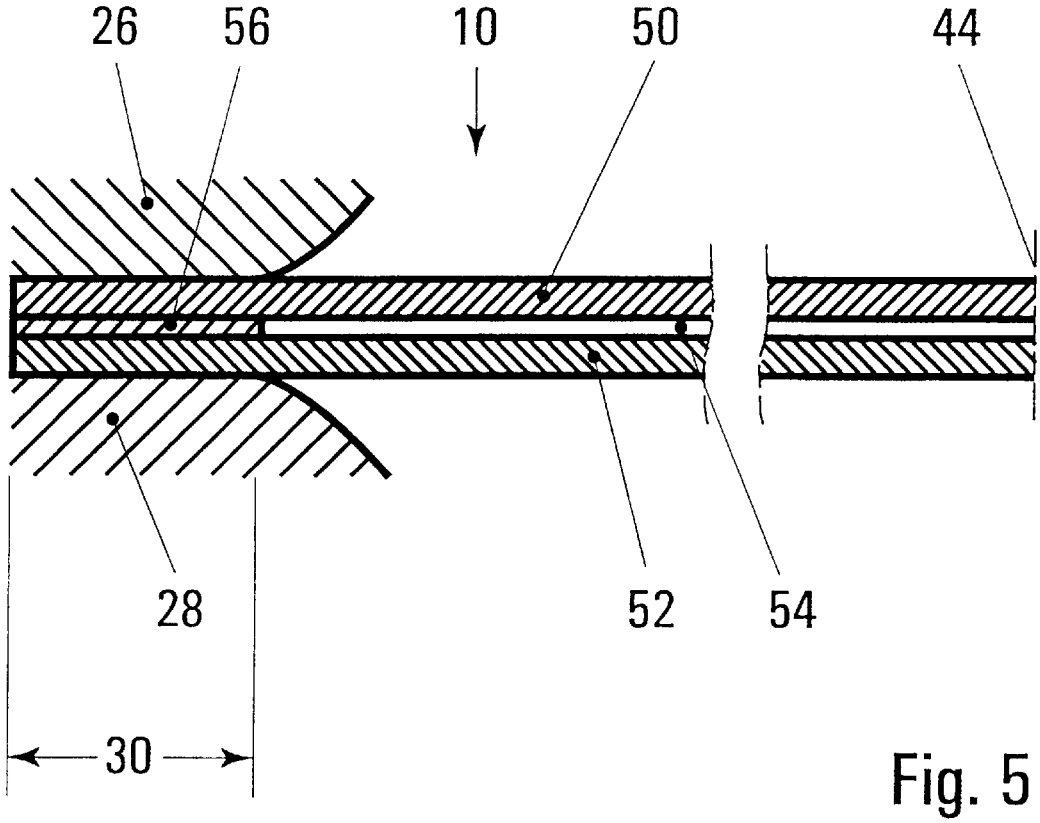
FIG. 5 shows a fourth embodiment of the elastic part.

In the embodiment according to FIG. 5, diaphragm 10 has two material layers 50, 52 between which there is a space 54 that, for example, is in fluid-conducting connection with a diaphragm rupture sensor, not shown. The elastic part here is made as intermediate ring or intermediate layer 56 and is arranged in chucking area 30 between material layers 50, 52 of diaphragm 10. In this way, diaphragm 10, so to speak, is positioned in a "floating" manner. The elasticity reserve of the diaphragm packet layers 50, 52 is increased as a result and the required minimum pressure is preserved in the chucking even in case of any possibly occurring part deformations. In order to ensure the fluid-conducting connection between space 54 and a possibly present diaphragm rupture sensor, the intermediate ring or intermediate layer 56 is made as a weft. The diaphragm rupture sensor then records the fluid that enters the space 54 as a result of the diaphragm rupture, which fluid then penetrates through the gaps in the weft all the way to the diaphragm rupture sensor.

In FIGS. 2–5, the number 44 refers to the middle of diaphragm 10, which at the same time can be considered as the rotationally symmetrical axis.

The elastic part 46 can also be made in the shape of at least one or several axially acting profile rings to achieve the desired elasticity adjustment.

I claim:

1. Diaphragm pump comprising:

a pump lid, a pump housing, a hydraulically driven diaphragm arranged between the pump housing and the pump lid, the diaphragm delimiting a hydraulic chamber from a delivery chamber and being clamped at a circulating rim, at least one of a first insert part located on a side of the pump lid and limiting the delivery chamber and a second insert part between the pump lid and the pump housing located on a side of the pump housing and limiting the hydraulic chamber, the diaphragm at the circulating rim being clamped between two of the pump housing, the pump lid, the first insert part and the second insert part, the first and the second insert parts, together with one of the pump lid and the pump housing, constituting tight sealing points for the diaphragm.

2. Diaphragm pump according to claim 1, wherein the delivery chamber is formed by the first insert part on the side of the pump lid and the first insert part located on the side of the pump lid has a first duct connecting the delivery chamber with a delivery duct made in the pump lid.

3. Diaphragm pump according to claim 2, wherein the first insert part located on the side of the pump lid, has a second duct connecting the delivery chamber with a suction duct made in the pump lid.

4. Diaphragm pump according to claim 1, wherein the pump lid and the pump housing have fastening means for connecting the pump lid and the pump housing with each other in a pressure-supported manner and that, simultaneously, the first insert part, located on the side of the pump lid, as well as the second insert part, located on the side of the pump housing with the diaphragm between them, will be pressed against each other in a chucking manner.

5. Diaphragm pump according to claim 1, wherein the first and the second insert parts are so arranged that they directly abut against each other in a radial area around the circulating rim.

6. Diaphragm pump according to claim 1, wherein two tight sealing points are arranged spaced on a same diameter.

7. Diaphragm pump according to claim 6, wherein the diameter of the tight sealing points is identical or greater in relation to a diameter of the circulating rim.

8. Diaphragm pump according to claim 1, wherein between the first and the second insert parts and the pump lid or the pump housing, there are arranged ducts or free turns so that pumping fluid will be spread all the way to the tight sealing points under pressure.

9. Diaphragm pump according to claim 1, wherein the diaphragm is so chucked between a predetermined press-on pressure between the pump lid and the pump housing that the pressure in an area of diaphragm chucking is below a yield pressure of a material of the diaphragm.

10. Diaphragm pump according to claim 1, wherein in a chucking area, there is provided at least one elastic part, which, when the diaphragm pump is in operation, the at least one elastic part will elastically adjust any occurring decreases in press-on pressure in the chucking area of the diaphragm between the pump lid and the pump housing.

11. Diaphragm pump according to claim 1, wherein the diaphragm comprises two or more material layers where at least one elastic part is arranged between at least two layers.

12. Diaphragm pump according to claim 11, wherein the elastic part is made as an elastic intermediate layer.

13. Diaphragm pump according to claim 11, wherein the elastic part is made as an elastic intermediate ring.

14. Diaphragm pump according to claim 10, wherein the elastic part extends in a circumferential direction over an entire circumference of the diaphragm.

15. Diaphragm pump according to claim 10, wherein the elastic part is arranged on at least one side of the diaphragm.

16. Diaphragm pump according to claim 10, wherein the elastic part comprises one or several elastomer O-rings.

17. Diaphragm pump according to claim 1, wherein the diaphragm is made of PTFE or PE.

18.Diaphragm pump according to claim 1, wherein the diaphragm is made of an elastomer with a protective layer consisting of PTFE.

19. Diaphragm pump comprising:

a pump lid, a pump housing, a hydraulically driven diaphragm arranged between the pump housing and the pump lid, the diaphragm delimiting a hydraulic chamber from a delivery chamber and being clamped at a circulating rim, at least one of a first insert part located on a side of the pump lid and limiting the delivery chamber and a second insert part between the pump lid and the pump housing located on a side of the pump housing and limiting the hydraulic chamber, the diaphragm at the circulating rim being clamped between two of the pump housing, the pump lid, the first insert part and the second insert part, the diaphragm including two or more material layers with at least one elastic part being arranged between at least two layers, the elastic part being made as a weft.

20. Diaphragm pump comprising:

a pump lid, a pump housing, a hydraulically driven diaphragm arranged between the pump housing and the pump lid, the diaphragm delimiting a hydraulic chamber from a delivery chamber and being clamped at a circulating rim, at least one of a first insert part located on a side of the pump lid and limiting the delivery chamber and a second insert part between the pump lid and the pump housing located on a side of the pump housing and limiting the hydraulic chamber, the diaphragm at the circulating rim being clamped between two of the pump housing, the pump lid, the first insert part and the second insert part, at least open elastic part provided in a chucking area, which, when the diaphragm pump is in operation, the at least one elastic part elastically adjusts any occurring decreases in press-on pressure in the chucking area of the diaphragm between the pump lid and the pump housing, the at least one elastic part being a lip seal.

21. Diaphragm pump comprising:

a pump lid, a pump housing, a hydraulically driven diaphragm arranged between the pump housing and the pump lid, the diaphragm delimiting a hydraulic chamber from a delivery chamber and being clamped at a circulating rim, at least one of a first insert part located on a side of the pump lid and limiting the delivery chamber and a second insert part between the pump lid and the pump housing located on a side of the pump housing and limiting the hydraulic chamber, the diaphragm at the circulating rim being clamped between two of the pump housing, the pump lid, the first insert part and the second insert part, at least open elastic part provided in a chucking area, which, when the diaphragm pump is in operation, the at least one elastic part elastically adjusts any occurring decreases in press-on pressure in the chucking area of the diaphragm between the pump lid and the pump housing, the at least one elastic part being an integral part of the diaphragm.

22. Diaphragm pump comprising:

a pump lid, a pump housing, a hydraulically driven diaphragm arranged between the pump housing and the pump lid, the diaphragm delimiting a hydraulic chamber from a delivery chamber and being clamped at a circulating rim, at least one of a first insert part located on a side of the pump lid and limiting the delivery chamber and a second insert part between the pump lid and the pump housing located on a side of the pump housing and limiting the hydraulic chamber, the diaphragm at the circulating rim being clamped between two of the pump housing, the pump lid, the first insert part and the second insert part with a predetermined press-on pressure such, that in an area of the diaphragm chucking said pressure is below a yield point of a material of the diaphragm, the first and second insert parts, together with one of the pump lid and the pump housing, constitute tight sealing points, and a diameter of the tight sealing points being identical or greater in relation to a diameter of the circulating rim, and between the first and the second insert parts and one of the pump lid and the pump housing, there are arranged ducts or free turns so that the pumping fluid will spread all the way to the tight sealing points under pressure.

23. Diaphragm pump according to claim 22, wherein the first and the second insert parts are so arranged that they directly abut against each other in a radial area around the circulating rim.

24. Diaphragm pump according to claim 22, wherein two tight sealing points are arranged spaced on a same diameter.

25. Diaphragm pump according to claim 22, wherein in a chucking area, there is provided at least one elastic part, which, when the diaphragm pump is in operation, the at least one elastic part will elastically adjust any occurring decreases in press-on pressure in the chucking area of the diaphragm between the pump lid and the pump housing.

26. Diaphragm pump according to claim 22, wherein the diaphragm comprises two or more material layers where at least one elastic part is arranged between at least two layers.

27. Diaphragm pump according to claim 26, wherein the elastic part is made as an elastic intermediate layer.

28. Diaphragm pump according to claim 26, wherein the elastic part is made as an elastic intermediate ring.

29. Diaphragm according to claim 26, wherein the elastic part is made as a weft.

30. Diaphragm pump according to claim 25, wherein the elastic part extends in a circumferential direction over an entire circumference of the diaphragm.

31. Diaphragm pump according to claim 25, wherein the elastic part is arranged on at least one side of the diaphragm.

32. Diaphragm pump according to claim 25, wherein the elastic part comprises one or several elastomer O-rings.

33. Diaphragm pump according to claim 25, wherein the elastic part is made as a lip seal.

34. Diaphragm pump according to claim 25, wherein the elastic part is made as an integral part of the diaphragm.

35. Diaphragm pump according to claim 22, wherein the diaphragm is made of one of PTFE and PE.

36. Diaphragm pump according to claim 22, wherein the diaphragm is made of an elastomer with a protective layer consisting of PTFE.

* * * * *